US008387969B2

(12) United States Patent
Sonoda et al.

(10) Patent No.: US 8,387,969 B2
(45) Date of Patent: Mar. 5, 2013

(54) SHEET FEEDING APPARATUS AND IMAGE FORMING APPARATUS

(75) Inventors: Shinya Sonoda, Yokohama (JP); Masato Izumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/159,612

(22) Filed: Jun. 14, 2011

(65) Prior Publication Data

US 2011/0241279 A1 Oct. 6, 2011

Related U.S. Application Data

(62) Division of application No. 11/772,958, filed on Jul. 3, 2007, now Pat. No. 7,980,548.

(30) Foreign Application Priority Data

Jul. 7, 2006 (JP) ..... 2006-187921

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 5,029,838 | A * | 7/1991 | Kunihiro | 271/119 |
| 5,346,199 | A * | 9/1994 | Martin et al. | 271/110 |
| 5,348,282 | A * | 9/1994 | Choi et al. | 271/117 |
| 5,377,970 | A * | 1/1995 | Kikuchi | 271/121 |
| 5,932,313 | A * | 8/1999 | Barton | 428/141 |
| 6,032,942 | A | 3/2000 | Cho | |
| 6,279,897 | B1 * | 8/2001 | Richards | 271/121 |
| 6,382,620 | B1 * | 5/2002 | Gaarder et al. | 271/117 |
| 6,467,765 | B2 * | 10/2002 | Yukimachi | 271/9.11 |
| 6,651,974 | B2 | 11/2003 | Kawarama et al. | |
| 6,877,736 | B2 | 4/2005 | Chung | |
| 7,004,460 | B2 * | 2/2006 | Ruhe et al. | 271/113 |
| 7,059,596 | B2 * | 6/2006 | Iwase | 271/114 |
| 7,147,218 | B2 | 12/2006 | Izumi et al. | |
| 7,165,765 | B2 | 1/2007 | Sonoda et al. | |
| 7,364,152 | B2 * | 4/2008 | Suwa | 271/118 |
| 7,384,033 | B2 | 6/2008 | Asada | |
| 7,413,183 | B2 | 8/2008 | Asada et al. | |
| 7,464,924 | B2 | 12/2008 | Morimoto et al. | |

(Continued)

FOREIGN PATENT DOCUMENTS

| | | |
|---|---|---|
| EP | 1800878 | 6/2007 |
| JP | 11-171354 | 6/1999 |

OTHER PUBLICATIONS

Official Letter/Search Report, issued Nov. 10, 2008, by the Korean Patent Office, in Korean Patent Application No. 10-2007-0067999.

(Continued)

*Primary Examiner* — Kaitlin Joerger
*Assistant Examiner* — Prasad V. Gokhale
(74) *Attorney, Agent, or Firm* — Fitzpatrick, Cella, Harper & Scinto

(57) ABSTRACT

A sheet feeding apparatus includes a sheet stacking portion for stacking a sheet, a sheet feeding roller for feeding the sheet stacked on said sheet stacking portion, a supporting member, rotatably supported by a base member, for rotatably supporting said sheet feeding roller, and a spring stretched between the base member and an acting portion of the supporting member. The acting portion of the supporting member is located downward with respect to a rotation center of the supporting member when a sheet stacking amount is small, and the acting portion of the supporting member is located upward with respect to a rotation center of the supporting member when a sheet stacking amount is large.

8 Claims, 12 Drawing Sheets

U.S. PATENT DOCUMENTS

| | | | | |
|---|---|---|---|---|
| 7,559,545 | B2 | 7/2009 | Asada | |
| 7,594,647 | B2 | 9/2009 | DeVore et al. | |
| 7,594,651 | B2 | 9/2009 | Hall et al. | |
| 7,641,187 | B2 | 1/2010 | Sonoda | |
| 2004/0070136 | A1* | 4/2004 | Chung | 271/117 |
| 2004/0245704 | A1* | 12/2004 | Hall et al. | 271/117 |
| 2004/0251592 | A1* | 12/2004 | Ruhe et al. | 271/109 |
| 2005/0023745 | A1* | 2/2005 | Morimoto et al. | 271/117 |
| 2005/0110206 | A1* | 5/2005 | Hsieh | 271/117 |
| 2005/0194732 | A1 | 9/2005 | Asada | |
| 2005/0194733 | A1* | 9/2005 | Asada | 271/117 |
| 2005/0275154 | A1 | 12/2005 | Sonoda | |
| 2006/0071399 | A1* | 4/2006 | Asada et al. | 271/117 |
| 2007/0052153 | A1* | 3/2007 | DeVore et al. | 271/117 |

OTHER PUBLICATIONS

Official Letter/Search Report, issued by the European Patent Office, dated Dec. 16, 2008, in European Patent Application No. 07013125.5.

Official Letter/Search Report, dated Mar. 13, 2009, issued by the Japanese Patent Office, in Japanesae Application No. 2007101228000.0.

* cited by examiner

SHEET FEEDING APPARATUS AND IMAGE FORMING APPARATUS

This is a divisional of U.S. patent application Ser. No. 11/772,958, filed Jul. 3, 2007, and allowed Apr. 11, 2001.

FIELD OF THE INVENTION AND RELATED ART

The present invention relates to a sheet feeding apparatus for picking up and feeding sheets one by one from a plurality of stacked sheets and an image forming apparatus using the sheet feeding apparatus.

Image forming apparatuses such as a recording apparatus, a printer, a facsimile apparatus, a copying machine, and multifunction machines of these apparatuses or machines have been used. The image forming apparatuses include a recording unit for recording an image (including a character, a symbol, etc.) on a recording medium such as recording paper or a plastic sheet on the basis of image information, and a reading unit for reading an image on an original. In these image forming apparatuses, in order to feed a sheet-like recording medium, the original, or the like (hereinafter referred to as a "sheet") to an image forming portion, a sheet feeding apparatus for separated and feeding sheets one by one from a plurality of stacked sheets is used. Types of the sheet feeding apparatus include one wherein sheet feeding is performed in a state in which sheets are substantially horizontally stacked and held at a lower portion of an image forming apparatus, one wherein sheet feeding is performed in a state in which sheets are inclined and stacked at a rear surface portion of an image forming apparatus, and one wherein sheet feeding can be performed both in the above described two states.

The sheet feeding apparatus for feeding sheets which are stacked and held substantially horizontally is constituted so that the sheets stacked substantially horizontally at a lower portion of a main assembly of the image forming apparatus are fed one by one in a U-turn manner to the image forming portion by turning the sheet upside down along a substantially cylindrical recessed surface.

The sheet feeding apparatus for feeding sheets which are stacked and held in an inclined state is constituted so that the sheets which are inclined and stacked at the rear surface portion of the main assembly of the image forming apparatus are fed to the image forming portion while being gradually placed in a substantially horizontal attitude. The former sheet feeding apparatus is suitable for feeding a thin sheet such as plain paper. The latter sheet feeding apparatus is suitable for formation of a photographic-quality image since a feeding load exerted on the sheet during the image formation can be reduced.

A sheet feeding means of the sheet feeding apparatus has types such as a rotation roller type in which the roller is rotationally driven about a fixed shaft (axis), and a swing arm type in which an arm rotated about a fixed shaft (axis) supports a roller at its end portion. A separating means for separating feeding sheets one by one may be of a bank separation type utilizing a resistance at a contact surface of a sheet leading end. In addition to the bank separation type, the type of the separation means may include a friction plate separation type utilizing a sliding frictional force of a separation pad or a retarding separation type utilizing a separation roller having a torque limiter. With respect to these separation types, it is desirable that the separating means used can smoothly separate a wide range of sheets from the thin sheet such as plain paper to a thick sheet such as glossy paper for photoprinting.

When the above described separation types are compared from the viewpoint of reliability of sheet separation, a higher reliability is ensured in the order of the retarding separation type, the friction plate separation type, and the bank separation type. However, this order is reversed from the viewpoint of cost. For this reason, in the sheet feeding apparatus used for feeding principally the thin sheet such as plain paper, the bank separation type utilizing the resistance at the contact surface of the sheet leading end is employed in many cases. Further, as the sheet feeding means in those cases, the swing arm type which does not require a press-contact plate and a cam mechanism and is capable of being constituted relatively easily is employed frequently.

As is well known in the art, the swing arm type sheet feeding means used a sheet feeding roller of a so-called pendulum arm type. More specifically, the sheet feeding means is constituted so that an arm attached to a driving shaft at one end portion (base end portion) rotatably supports the sheet feeding roller at the other end portion thereof and a driving force from the driving shaft is transmitted to the sheet feeding roller through an idler gear supported at an intermediary portion of the arm. In such a swing arm type sheet feeding means, when the number of stacked sheets is changed, an angle $\theta$ formed between a surface of the sheet and a line segment connecting a contact point of the sheet feeding roller with the sheet and a center of the driving shaft is changed. As a result, a contact force acting from the sheet feeding roller onto an upper surface of the sheet is changed. This contact force is increased with a decreasing number of the stacked sheets, so that a sheet feeding performance by rotation of the sheet feeding roller is lowered as the number of the stacked sheets is increased. U.S. Patent Application Publication No. U.S. 2004/0251592 A1 has disclosed a technique using an auxiliary arm spring 126 with respect to a sheet feeding arm 122 supporting a sheet feeding roller 121 in order to complement a contact force of the sheet feeding roller 121 when the number of the stacked sheets is large. In this case, the auxiliary arm spring 126 is used for complementing a decrease in contact force when the number of the stacked sheets is large but rather increases the contact force of the sheet feeding roller when the number of the stacked sheets is small or the sheets are not stacked.

In the above described bank separation type sheet feeding apparatus, as also shown in FIG. 11 of U.S. 2004/0251592 A1, a method in which leading ends of sheets are pressed against an angled wall (separation wall) located at a front position of a sheet feeding tray to separate next-to-top sheets from a top sheet is employed. This separation wall also functions as a load stop to prevent a user from pushing sheets too far into a feeding path with the leading ends of the sheets passing over the sheet feeding roller when the user loads or sets the sheets such as recording paper or the like in the sheet feeding tray.

Incidentally, when sheets are set in the above described sheet feeding apparatus using the swing arm type sheet feeding means, it is necessary to push the sheet to a stacking position against the contact force of the auxiliary arm spring 126 and the self-weight of the sheet feeding arm 122. However, in the sheet feeding apparatus disclosed in U.S. 2004/0251592 A1, inconvenience has been caused when a small amount of the thin sheets such as recording paper or the like is pushed into the sheet feeding apparatus placed in a state in which the number of stacked sheets is decreased and the contact force of the sheet feeding roller is increased. That is, the small amount of recording paper has a small rigidity, so that the sheet feeding apparatus has been accompanied with technical problems such that buckling of the sheets is induced and that setting of the sheets is difficult.

Further, in an image forming apparatus, when a sheet is fed from a sheet feeding roller to a conveying roller disposed downstream from the sheet feeding roller and then the conveying roller conveys the sheet, a drive is switched. For this reason, the image forming apparatus is constituted in some cases so that the drive of the sheet feeding roller is interrupted before the conveyance of the sheet by the conveying roller is started. In such an image forming apparatus, a positional relationship between the sheet and the sheet feeding roller during the conveyance of the sheet by the conveying roller is such that a trailing end of the sheet is still located at a position in from of a position at which the sheet trailing end completely passes through the sheet feeding roller. Accordingly, when the sheet passes through the sheet feeding roller, the resistance by the self-weight of the sheet feeding roller acts on the sheet, so that the swing arm can be raised by the fed sheet. At a subsequent moment, the raised swing arm falls by the self-weight of the swing arm to cause a force for pressing down the sheet to act on the sheet. As a result, during the sheet conveyance, a vertical reciprocating motion of the swing arm is repeated, so that a lowering in feeding (conveyance) accuracy and an occurrence of noise have been caused.

In such a sheet feeding apparatus that the apparatus is constituted so that sheet separation is effected by pressing the leading ends of the sheets against the angled wall located at the front position of the tray, the resistance against the sheet feeding is increased when an angle of the angled wall with respect to the sheets is excessively large, i.e., when the angle comes close to a right angle. As a result, the sheet feeding is unstable or cannot be performed in some cases. On the other hand, when the angle of the angled wall is gentle, a separating performance is lowered, so that a top sheet is fed together with next-to-top sheet(s) in some cases. Further, a proper angle of the angled wall varies depending on differences in material or rigidity of the sheet and in sheet feeding mechanism, so that it is difficult to stabilize a separating function only by angle adjustment of the angled wall. In order to solve these problems, in the conventional image forming apparatus, a method in which a separating pad formed of a rubber material is protruded from the surface of the angled wall to improve the separating performance has been employed. However, in such a method, a resistance acting from the protruded portion to a sheet end portion is large, so that the fed sheet has been damaged in some cases. Further, the separating pad formed of the rubber material is fixedly provided in the image forming apparatus, so that the image forming apparatus has been increased in cost.

SUMMARY OF THE INVENTION

A principal object of the present invention is, even when a small amount of sheets is set in a stacking portion, to provide a sheet feeding apparatus in which the sheets can be easily set without causing inconveniences such as buckling of the sheets and the like.

Another object of the present invention is to provide a sheet feeding apparatus capable of ensuring a sheet pressing force of a sheet feeding means and maintaining a stable sheet feeding performance even when an amount of stacked sheets is large.

According to an aspect of the present invention, there is provided a sheet feeding apparatus comprising:

a sheet stacking portion for stacking a sheet;

a sheet feeding roller for feeding the sheet stacked on the sheet stacking portion;

a supporting member, rotatably supported by a base member, for rotatably supporting the sheet feeding roller; and a spring stretched between the base member and the supporting member;

wherein the spring acts on the sheet feeding roller so that the sheet feeding roller is pressed against the sheet with a pressing force by rotation of the supporting member when a sheet stacking amount is more than a predetermined amount and so that the pressing force is decreased when the sheet stacking amount is less than the predetermined amount.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
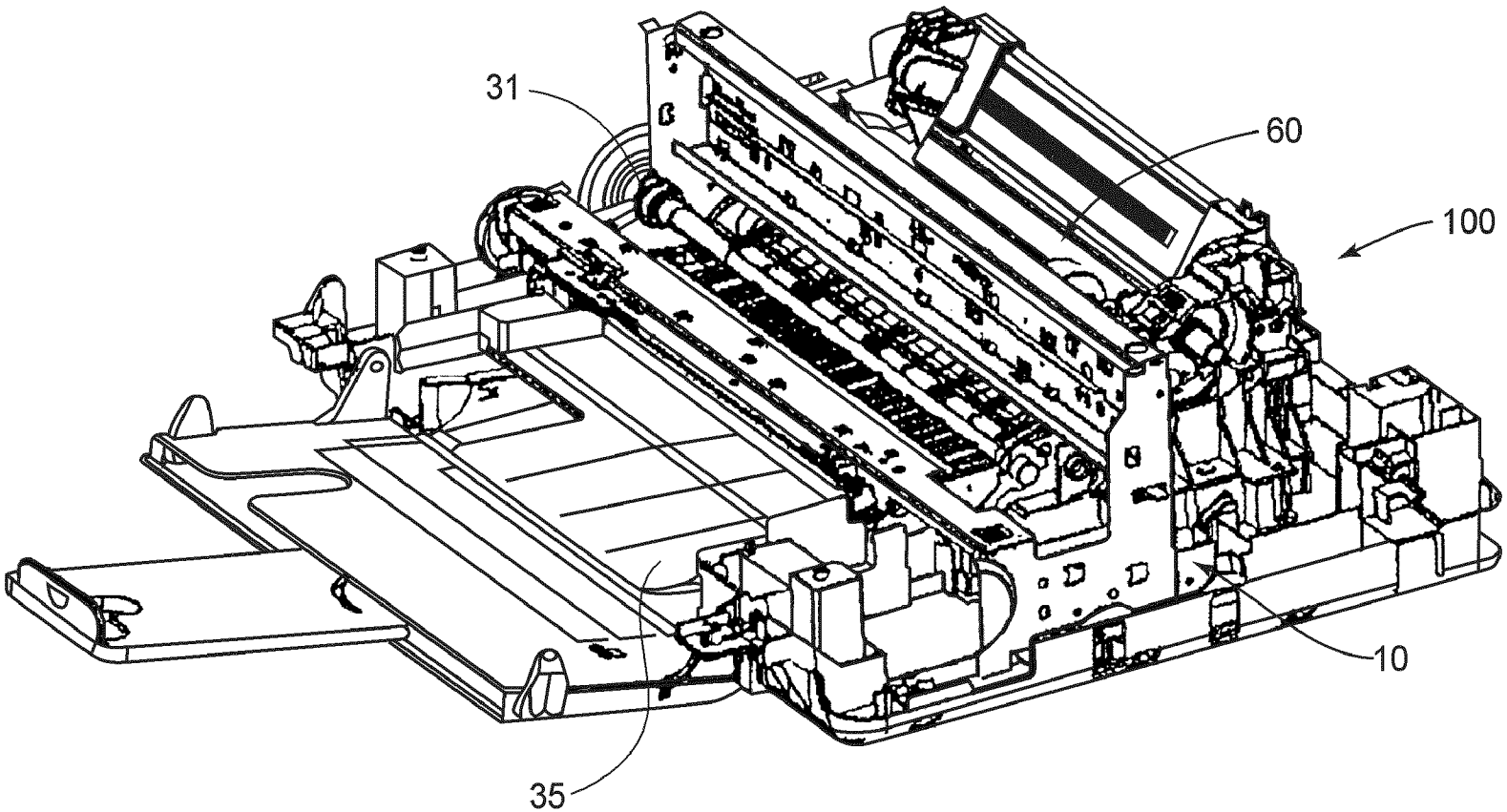
FIG. 1 is a perspective view showing an embodiment of a sheet feeding apparatus for an image forming apparatus according to the present invention.
Figure 2:
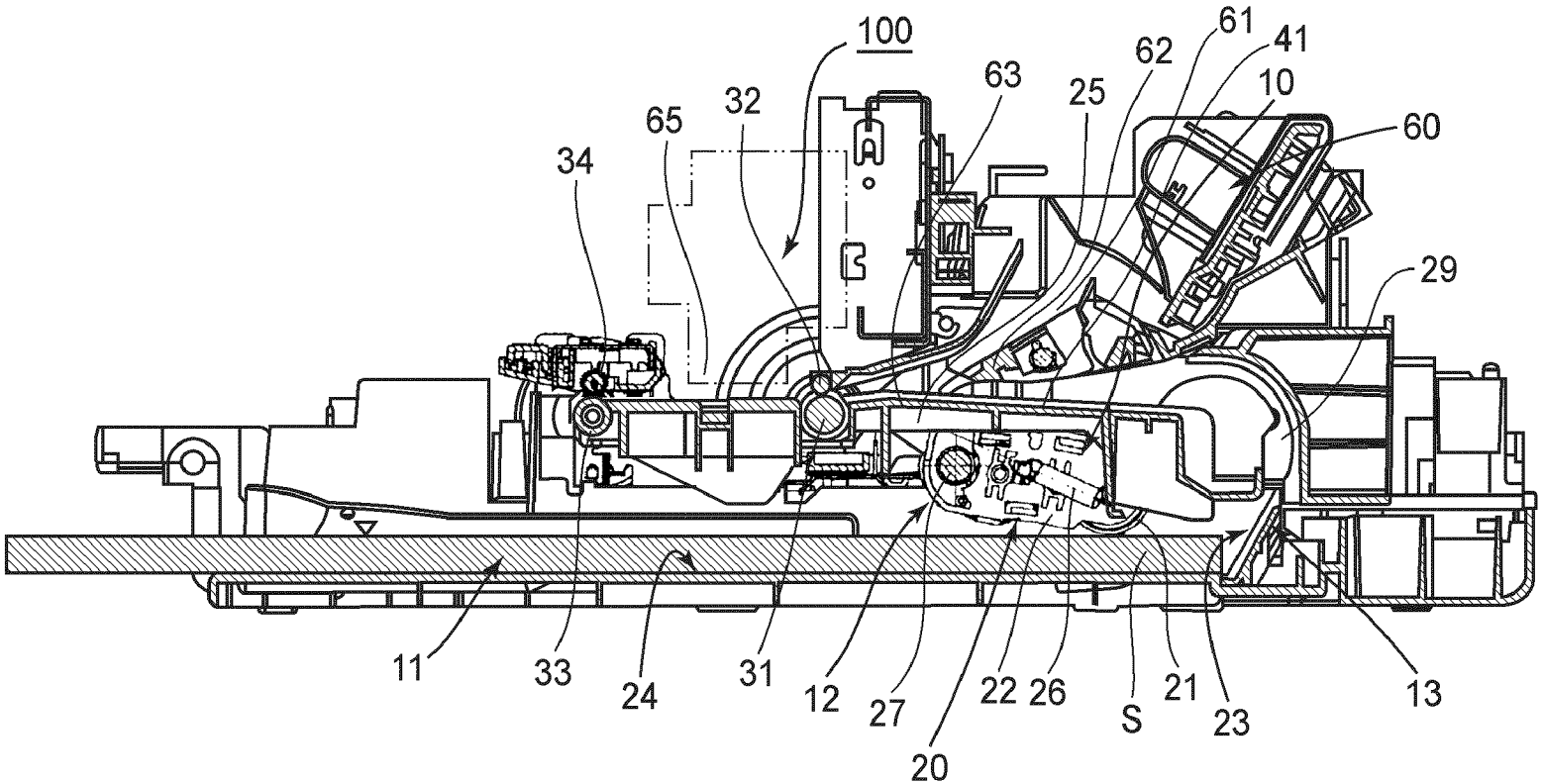
FIG. 2 is a longitudinal sectional view of the sheet feeding apparatus shown in FIG. 1.

Hereinbelow, embodiments of the present invention will be described more specifically with reference to the drawings. In the drawings, identical reference numerals represent identical or corresponding portions or members. FIG. 1 is a perspective view showing an embodiment of a sheet feeding apparatus of an image forming apparatus according to the present invention. FIG. 2 is a longitudinal sectional view of the sheet feeding apparatus shown in FIG. 1. Referring to FIGS. 1 and 2, a sheet feeding apparatus 10 is roughly constituted by a sheet stacking portion 11, a sheet feeding portion 12, a separating portion 13, and a conveying (feeding) path 29. The conveying path 29 of the sheet feeding apparatus 10 according to this embodiment is constituted as a U-turn type reverse conveying path for conveying (feeding) a sheet S while turning the sheet S upside down as described later. The sheet S fed from the sheet feeding apparatus 10 is conveyed by a nip between a conveying roller 31 and a pinch roller 32 through an image forming portion constituted by a recording portion or a reading portion. In the case of the recording portion, an image is recorded on a sheet as a recording medium by an unshown recording head and thereafter the sheet is discharged to the outside of an apparatus main assembly by a sheet discharge roller 33 and a spur 34. On the other hand, in the case of the reading portion, an image on a sheet as an original is read by an unshown contact image sensor and thereafter the sheet is discharged on a sheet discharge tray 35 by the nip between the sheet discharge roller 33 and the spur 34.

The sheet stacking portion 11 is disposed in the neighborhood of a bottom portion of an image forming apparatus 100 and constituted so that sheets are substantially horizontally stacked and held. By stacking the sheets horizontally, the sheets can be held in a state in which distortion thereof less occurs for a long period of time. The sheet feeding portion 12 includes a rotatably supported swing arm 22. At an end portion of the swing arm 22, a sheet feeding roller 21 is supported. To the swing arm 22, a driving force transmitting mechanism, such as idler gears 28 and the like, for transmitting a driving force to the sheet feeding roller 21 is also mounted. Further, the swing arm 22 is rotatably (swingably) supported at a position upstream from the sheet feeding roller 21 in a sheet feeding direction by a swing arm supporting member 63 fixed to a sheet feeding base 25. A swing arm type sheet feeding means 20 is constituted by the swing arm 22, the sheet feeding roller 21 mounted to the swing arm 22, the driving force transmitting mechanism, etc. At a leading end portion of the sheet stacking portion 11, a leading end reference portion 23 for the sheets S is provided. In the neighborhood of the sheet stacking portion 11, a bank separation type separating portion 13 constituted by utilizing the leading end reference portion 23 is disposed. The bank separation separating portion 13 is constituted so as to be suitable for separation and feeding of a relatively thin sheet particularly such as plain paper.

First, the constitution of the sheet stacking portion 11 will be described. In FIGS. 1 and 2, the sheet stacking portion 11 includes a stacking surface on which a plurality of sheets S is held substantially horizontally with an image recording surface or an image reading surface down and the leading end reference portion 23 for holding leading ends of the stacked sheets S. The leading end reference portion 23 also functions as a bank surface (inclined surface 46) of the separating portion 13 described later. The leading end reference portion 13 is provided at an obtuse angle with respect to the sheets S stacked in an attitude close to a horizontal state. The sheets S set in the sheet stacking portion 11 is stacked substantially in parallel with the bottom surface of the image forming apparatus 100, so that the sheets S are urged downwardly by gravitation and set in a state in which the leading ends contact the leading end reference portion 23. In this embodiment, in order to reduce a resistance load of a sheet to be fed, the leading end reference portion 23 is formed of a plurality of ribs (the inclined surface 46 described later) parallel to the feeding direction.

When the sheet feeding apparatus 10 is placed in a standby state, as shown in FIG. 2, the sheet feeding roller 21 contacts an upper surface of the stacked sheets S (upper surface of the uppermost sheet) by self-weight of the swing arm type sheet feeding means 20. When the sheet feeding roller 21 starts rotation in this state, it can perform a sheet feeding operation without actuating other movable parts. When sheets S are supplied to the sheet stacking portion 11, the sheets S are pushed into the sheet feeding apparatus 10 along the stacking surface 24 as they are. When the sheets S are pushed into the sheet feeding apparatus 10, the sheet feeding roller 21 is rotated and the swing arm 22 is raised upwardly about a rotation shaft by an end portion of the sheets S. As a result, it is possible to simply and smoothly set the sheets S with no particular operation.

Figure 3:
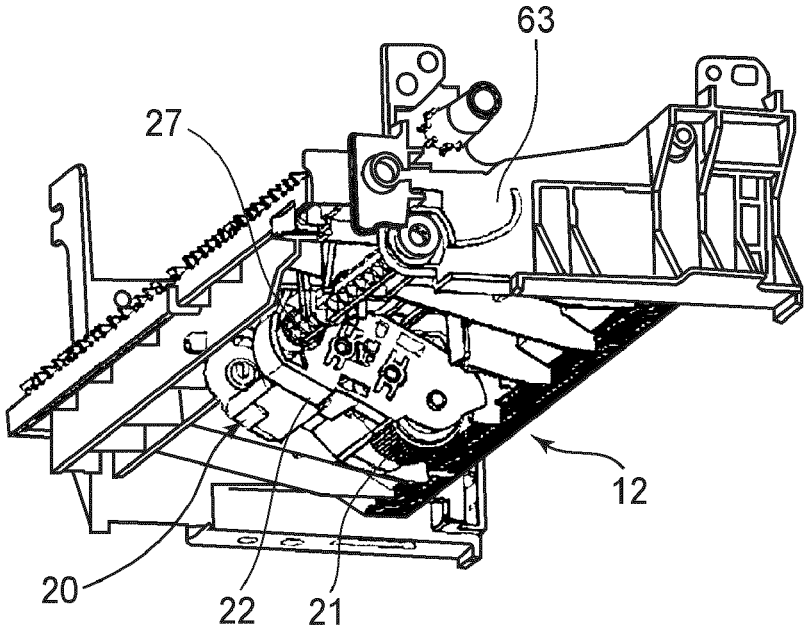
FIG. 3 is a perspective view of a sheet feeding means and its supporting member when viewed from below the sheet feeding means and the supporting member.
Figure 4:
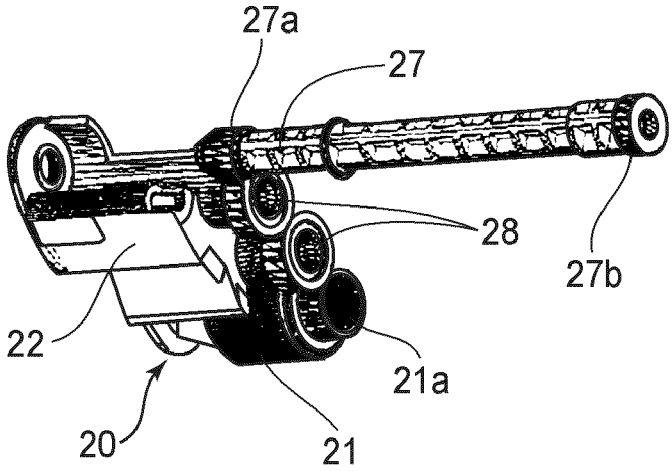
FIG. 4 is a perspective view showing a driving force transmitting mechanism of the sheet feeding means shown in FIG. 3.
Figure 5:
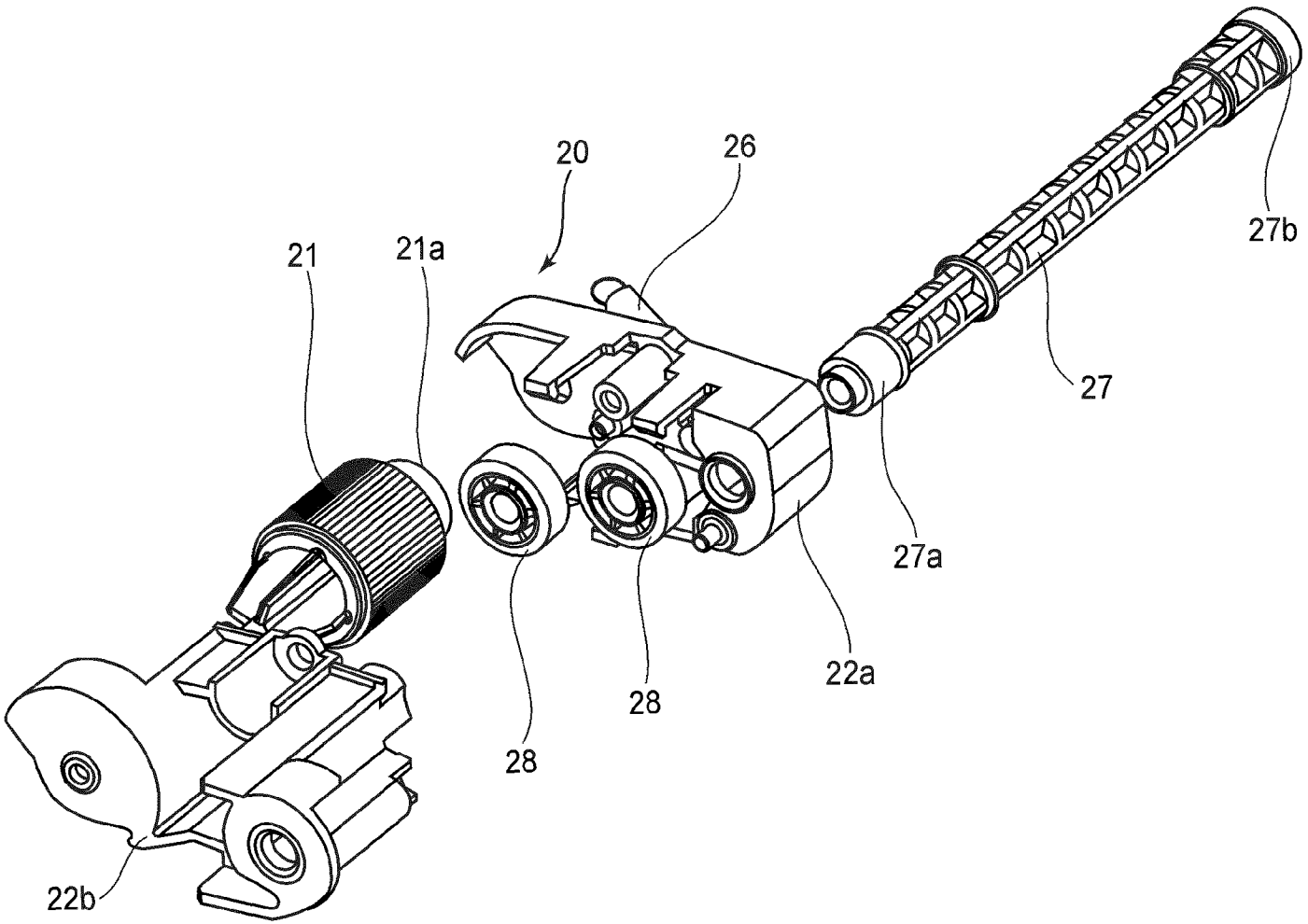
FIG. 5 is an exploded perspective view of the driving force transmitting mechanism, of the sheet feeding means, shown in FIG. 4.
Figure 6:
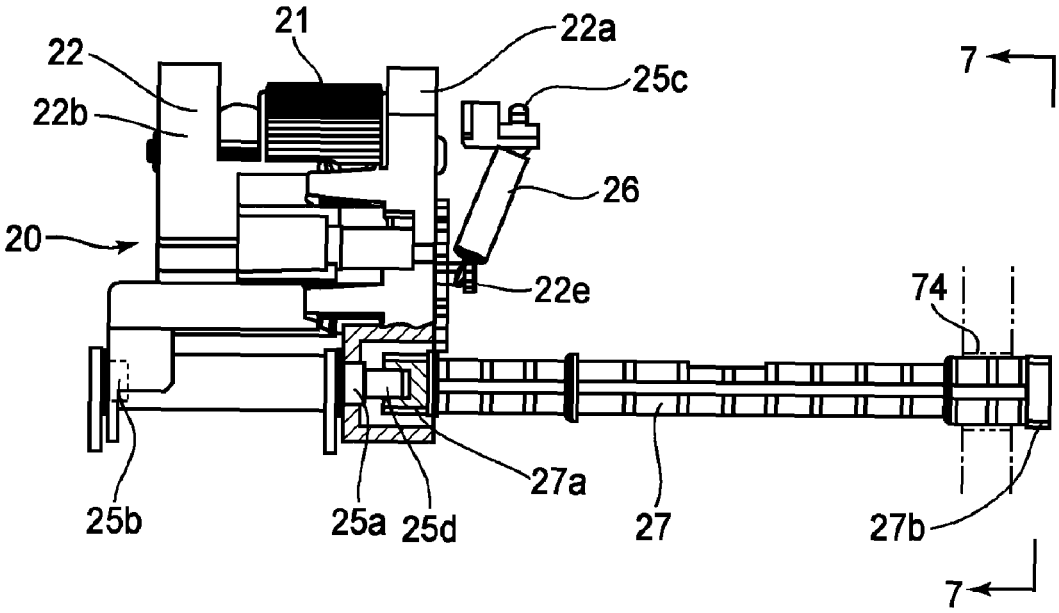
FIG. 6 is a plan view showing the driving force transmitting mechanism shown in FIGS. 4 and 5.
Figure 7:
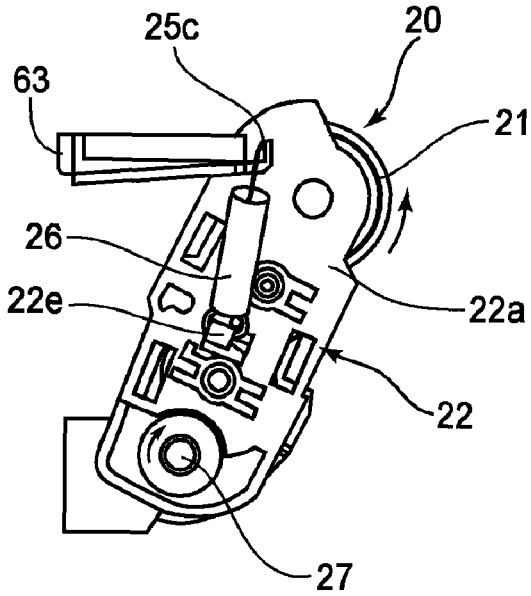
FIG. 7 is a side view when the driving force transmitting mechanism is viewed from 7-7 line indicated in FIG. 6.

Next, constitutions of the sheet feeding portion 12 and the separating portion 13 will be described. FIG. 3 is a perspective view of the sheet feeding means 20 constituting the sheet feeding portion 12 and its supporting member when viewed from below the sheet feeding means 20 and the supporting member. FIG. 4 is a perspective view showing a driving force transmitting mechanism of the sheet feeding means shown in FIG. 3. FIG. 5 is an exploded perspective view of the driving force transmitting mechanism, of the sheet feeding means, shown in FIG. 4. FIG. 6 is a plan view showing the driving force transmitting mechanism shown in FIGS. 4 and 5. FIG. 7 is a side view when the driving force transmitting mechanism is viewed from 7-7 line indicated in FIG. 6.

In FIGS. 3 to 7, a reference numeral 21 represents a sheet feeding roller and a reference numeral 21*a* represents a sheet feeding roller gear provided at one end of the sheet feeding roller 21. A reference numeral 22 represents a swing arm for supporting the sheet feeding roller 21 so as to permit driving force transmission and reference numerals 22*a* and 22*b* represent arm portions constituting right and left portions of the swing arm 22. A reference numeral 26 represents an urging spring stretched between a hook portion 22*e* of the swing arm 22 and a hook portion 25*c* of the sheet feeding base 25. A reference numeral 27 represents a driving shaft for transmitting a driving force to the sheet feeding roller 21. A reference numeral 27*a* represents an output gear portion of the driving shaft 27 and a reference numeral 27*b* represents an input gear portion for transmitting the driving force from an unshown driving source to the driving shaft 27. By the swing arm 22, the idler gears 28 for transmitting the driving force from the output gear portion 27*a* of the driving shaft 27 to the sheet feeding roller gear 21*a* are supported. By the driving force transmitted to the driving shaft 27, the sheet feeding roller 21 is rotationally driven via the sheet feeding roller gear 21*a*.

To the sheet feeding base 25, the swing arm supporting member 63 is integrally fixed. The swing arm 22 is rotatably (swingably) attached to a lower surface of the swing arm supporting member 63. In this embodiment, the arm portions 22*a* and 22*b* constituting the swing arm 22 are rotatably supported by concentric shaft portions 25*a* and 25*b* provided to the swing arm supporting member 63. An end portion of the driving shaft 27 on the swing arm side is rotatably engaged with and supported by a projection shaft portion 25*d* coaxially formed at an end of the shaft portion 25*a* of the sheet feeding base 25. The other end portion of the driving shaft 27 is rotatably supported by a shaft-supporting hole 74 provided in the sheet feeding base 25. In this manner, the swing arm type sheet feeding means 20 is swingably supported by the shaft portions 25*a* and 25*b* concentric with the driving shaft 27. Further, the shaft portions 25*a* and 25*b* are disposed upstream from the sheet feeding roller 21 with respect to the sheet feeding direction.

In FIG. 6, the urging spring 26 is constituted by a tension spring stretched between the hook portion 22*e* provided to the arm portion 22*a* and the hook portion 25*c* provided to the sheet feeding base 25. In FIG. 7, when the driving shaft 27 is rotated in a clockwise direction indicated by an arrow, a rotation force is transmitted to the sheet feeding roller gear 21*a* via the output gear portion 27*a* and the two idler gears 28. The sheet feeding roller 21 is rotationally driven in a counterclockwise direction indicated by an arrow shown in FIG. 7 by the rotation of the sheet feeding roller gear 21*a*.

Next, the U-turn conveying path 29 constituting a part of the sheet feeding apparatus according to this embodiment will be described.

The separating uppermost single sheet S is fed through a cylindrical reverse conveying (feeding) path (U-turn conveying path) 29 as shown in FIG. 2 by the rotation of the sheet feeding roller 21. The image forming apparatus according to this embodiment includes a second sheet feeding apparatus 60 at an upper rear portion of an apparatus main assembly. The reverse conveying path 29 is connected to a horizontal conveying path 41 formed in a substantially horizontal direction on a lower side of the second sheet feeding apparatus 60. The horizontal conveying path 41 merges with a sheet feeding/conveying path 61 from the second sheet feeding apparatus 60 on an upstream side of the conveying roller 31 with respect to the sheet feeding direction. At the merging (meeting) point, a switching flapper 62 for switching between sheet feeding from the sheet feeding apparatus 10 and sheet feeding from the sheet feeding apparatus 60 is provided. In the case where a sheet S is fed from the sheet feeding apparatus 10 through the reverse conveying path 29, the switching flapper 62 is switched to a mode in which the sheet S is fed from the horizontal conveying path 41 to the conveying roller 31. In this embodiment, the horizontal conveying path 41 is formed at an upper surface of the swing arm supporting member 63 by which the swing arm is swingably supported.

The sheet S fed by the sheet feeding roller 21 is turned upside down by the reverse conveying path 29 and thereafter is sent in the nip between the conveying roller 31 and the pinch roller 32 through the horizontal conveying path 41. Then, the sheet feeding operation by the sheet feeding roller 21 is stopped and rotational drive of the conveying roller 31 is started. By synchronized rotation of the conveying roller 31 with the sheet discharge roller 33, the sheet S is conveyed through an image forming portion (image processing portion) 65. The thus image-formed sheet is discharged onto the sheet discharge tray 35 through the sheet discharge roller 33.

Figure 8:
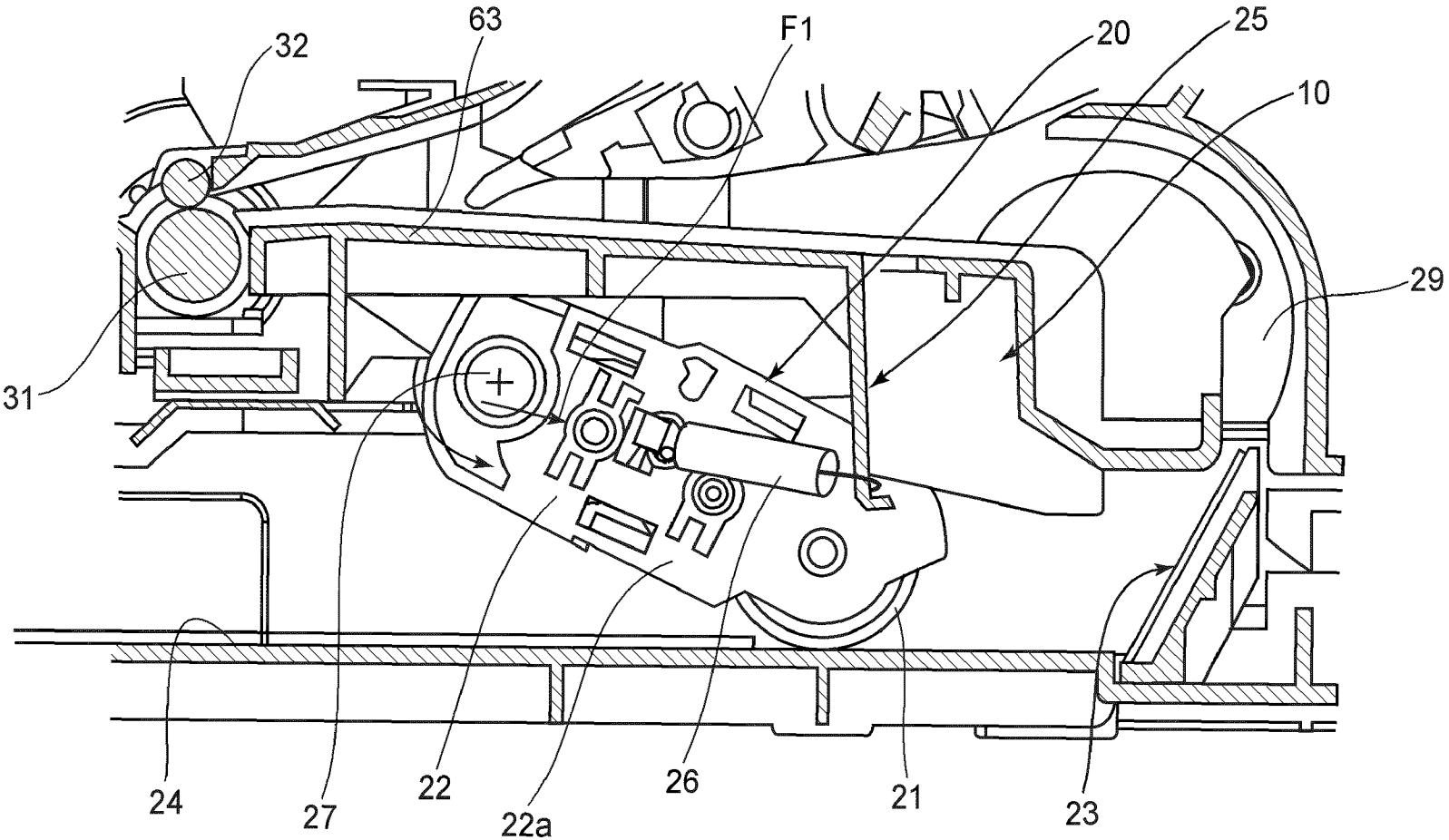
FIG. 8 is a longitudinal sectional view showing a state in which an amount of stacked sheets in the sheet feeding apparatus according to the embodiment of the present invention is small or there are no stacked sheets.
Figure 9:
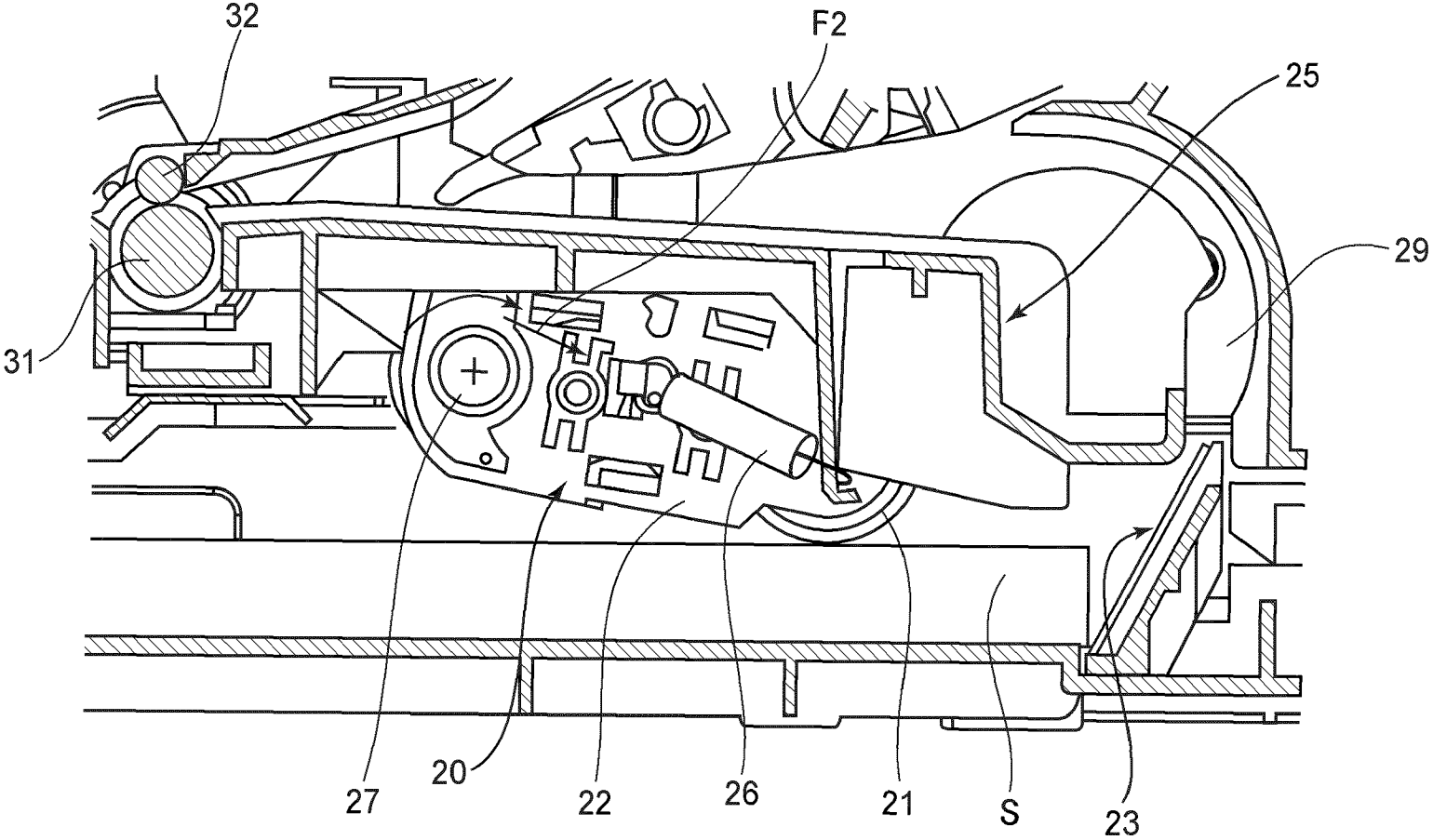
FIG. 9 is a longitudinal sectional view showing a state in which the amount of stacked sheets in the sheet feeding apparatus shown in FIG. 8 is large.

FIG. 8 is a longitudinal sectional view showing a state in which an amount of stacked sheets in the sheet feeding apparatus according to the embodiment of the present invention is small or there are no stacked sheets. FIG. 9 is a longitudinal sectional view showing a state in which the amount of stacked sheets in the sheet feeding apparatus shown in FIG. 8 is large. With reference to FIGS. 8 and 9, a constitution and operation of the sheet feeding apparatus 10 according to this embodiment will be described. The axis of the driving shaft 27 coincides with a rotation (swing) center of the swing arm 22. Between the hook portion 25*c* provided to the supporting member 63 and the hook portion 22*e* provided to the swing arm 22, the urging spring 26 is stretched. A line of action of the urging spring 26 is determined by positions of the hook portion 25*c* and the hook portion 22*e* and a rotation position of the swing arm 22.

When there are no stacked sheets or the amount of the stacked sheets is small, as shown in FIG. 8, the swing arm type sheet feeding means 20 including the swing arm 22 and the driving force transmitting mechanism is lowered by its own weight to a position at which the sheet feeding roller 21 contacts or comes near to the stacking surface 24. On the other hand, when the amount of the stacked sheets is large, as shown in FIG. 9, the sheet feeding roller 21 is raised by the set sheets, so that the position of the sheet feeding means 20 is raised to a position at which the sheet feeding means 20 is rotationally moved from the position shown in FIG. 8 about a supporting shaft thereof in a counterclockwise direction indicated by an arrow. Further, a moment by self-weight of the sheet feeding means 20 acts about the supporting shaft in a clockwise direction so that the sheet feeding roller 21 is pressed against the stacked sheets.

In the case where there is no sheet or a small amount of sheets in the sheet stacking portion 1, as shown in FIG. 8, a spring force F1 of the urging spring 26 acts downwardly with respect to the rotation center of the swing arm 22 (toward the stacked sheets), so that a moment in the counterclockwise direction indicated by the arrow acts on the swing arm 22. For this reason, a moment in a direction of canceling a contact force by self-weight of the swing arm type sheet feeding means 20 is generated. As a result, when the sheets are inserted into the sheet stacking portion 11, it is possible to raise the swing arm 22 via the sheet feeding roller 21 by a relatively small force, so that the sheet feeding roller 21 can be easily moved upwardly. Therefore, it is possible to improve operativity during the setting of the sheets. That is, according to this embodiment, it is possible to easily and smoothly set the sheets with respect to the sheet stacking portion 11 without using a means such as a swing arm raising mechanism for releasing the pressing force of the sheet feeding roller 21.

In the case of a large amount of the sheets S stacked at the sheet stacking portion 11, as shown in FIG. 9, a spring force F2 of the urging spring 26 acts upwardly with respect to the rotation center of the swing arm 22 (in a direction of being moved apart from the stacked sheets S), so that a moment in the clockwise direction indicated by the arrow acts on the swing arm 22. For this reason, in addition to the contact force by self-weight of the swing arm type sheet feeding means 20, a force of pressing the sheet feeding roller 21 against the sheets S is caused to act by the moment of the urging spring 26. That is, in the case of the large sheet stacking amount, a contact force between the sheet feeding roller 21 and the sheets S is increased by the action of the sheet pressing force by the urging spring 26 in addition to the pressing force by self-weight of the swing arm type sheet feeding means 20.

In a conventional swing arm type sheet feeding mechanism, a sheet feeding force by rotation of the sheet feeding roller 21 is decreased with an increasing amount of stacked sheets. For this reason, in the case of a large number of the stacked sheets, it was difficult to obtain a desired sheet feeding force in some cases. On the other hand, according to this embodiment, when the sheet stacking amount is large, it is possible to cause the pressing force by the moment of the urging spring 26 to act on the sheets in addition to the pressing force by the self-weight moment of the sheet feeding means 20. For this reason, even in the case where the sheet stacking amount is large, it is possible to generate a sufficient and stable sheet feeding force, so that a good sheet feeding performance can be maintained.

Figure 10:
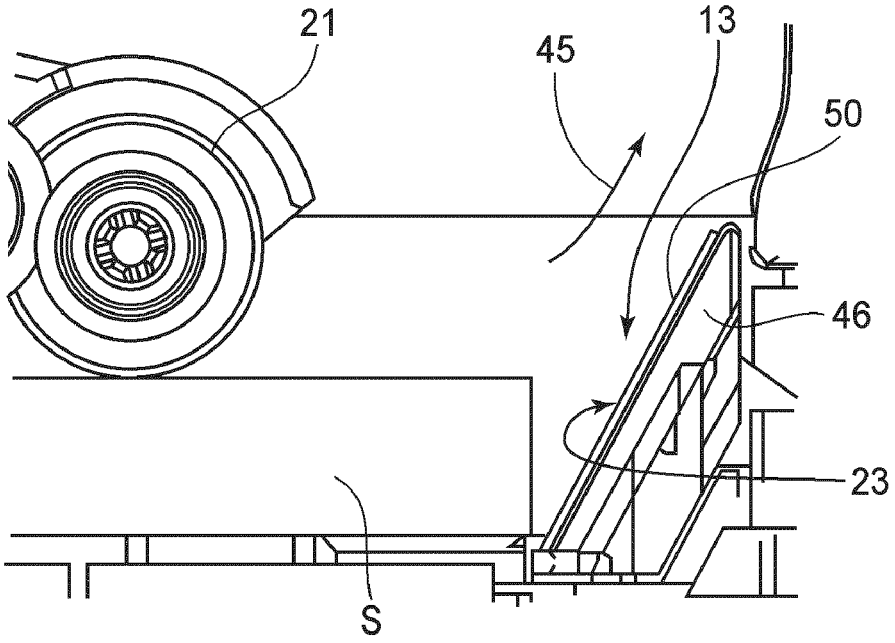
FIG. 10 is a side view showing a separating portion of the sheet feeding apparatus according to the embodiment of the present invention.
Figure 13:
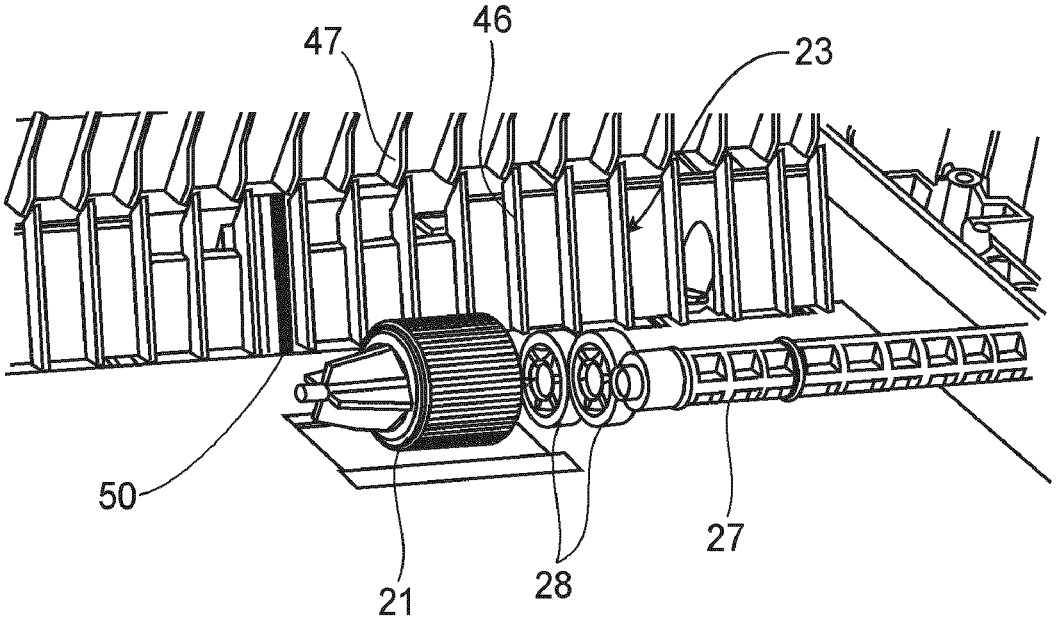
FIG. 13 is a front perspective view of a separating portion viewed from a sheet feeding roller side.
Figure 11:
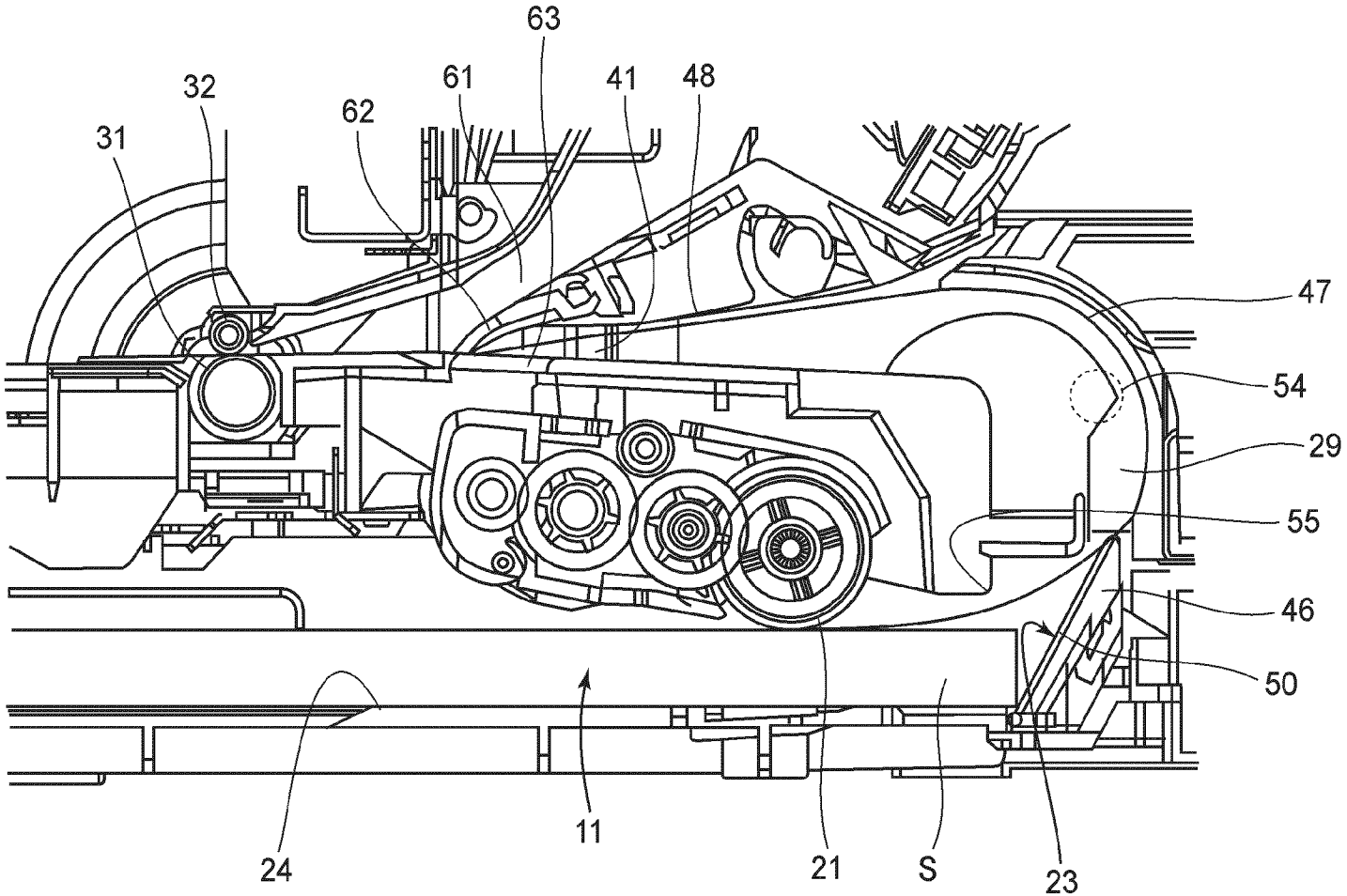
FIG. 11 is a longitudinal sectional view showing an attitude of a sheet fed from a sheet feeding roller to a conveying roller.
Figure 12:
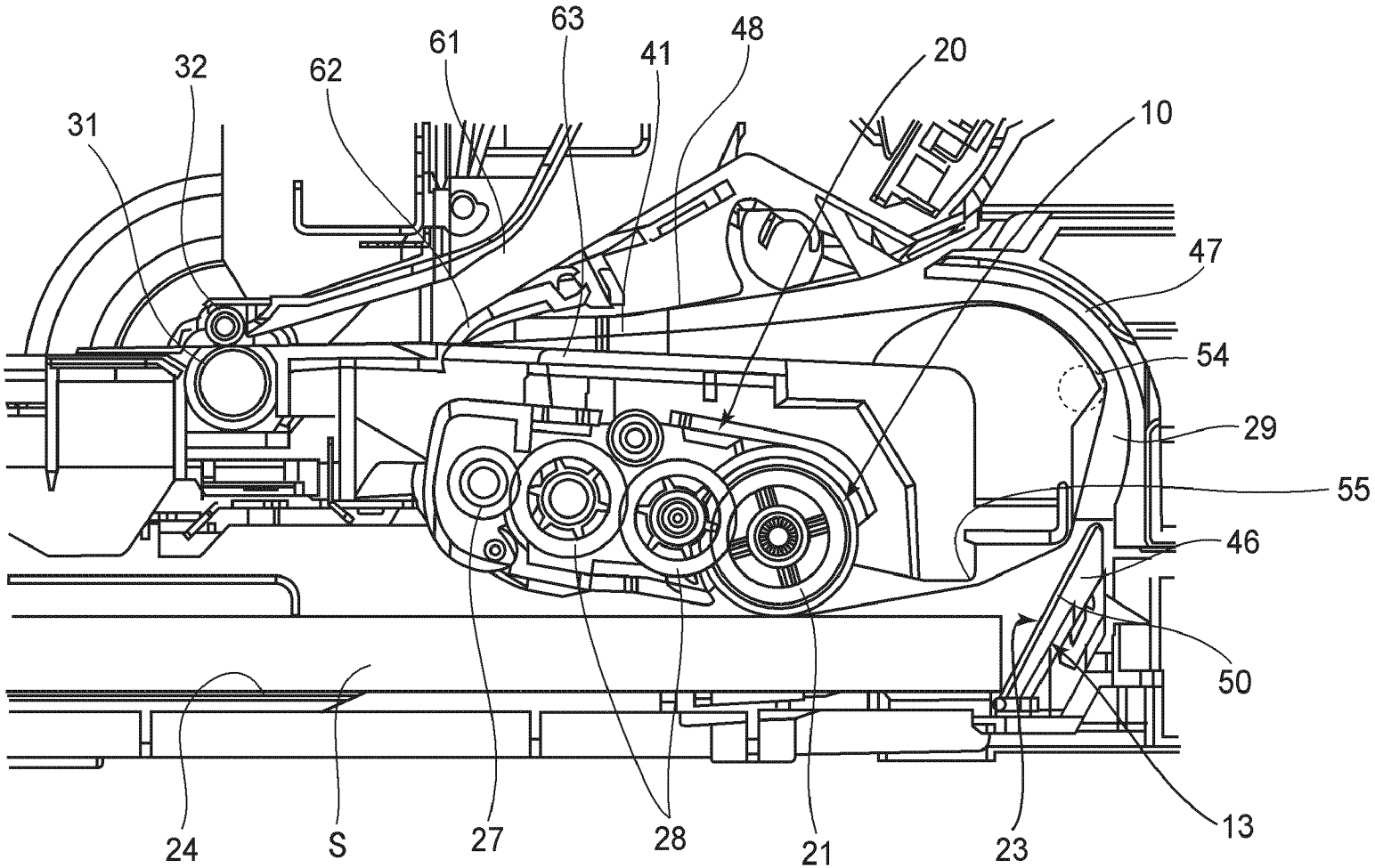
FIG. 12 is a longitudinal sectional view showing an attitude of a sheet conveyed by the conveying roller.
Figure 14:
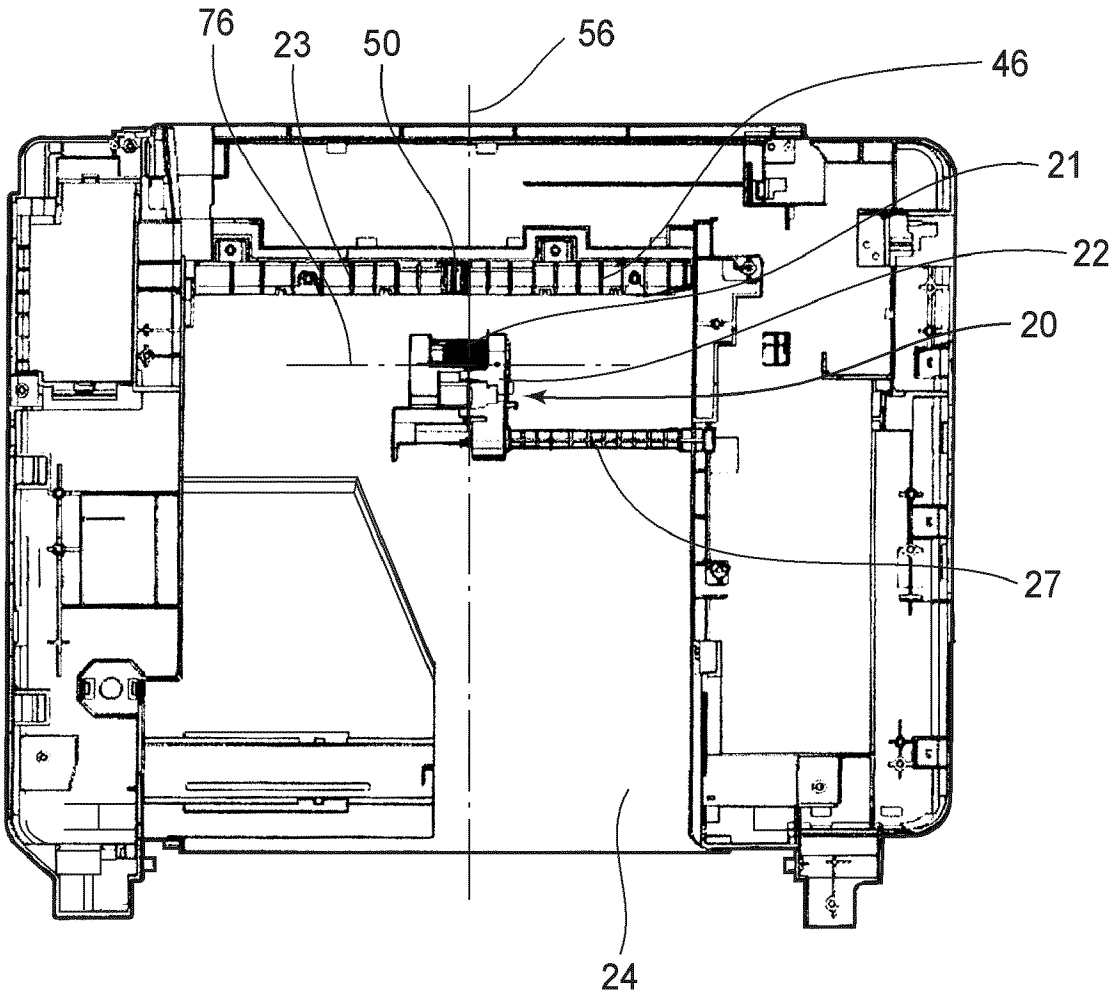
FIG. 14 is a plan view showing the sheet feeding apparatus according to the embodiment of the present invention, wherein a part of constitutional members of the sheet feeding apparatus is omitted.
Figure 15:
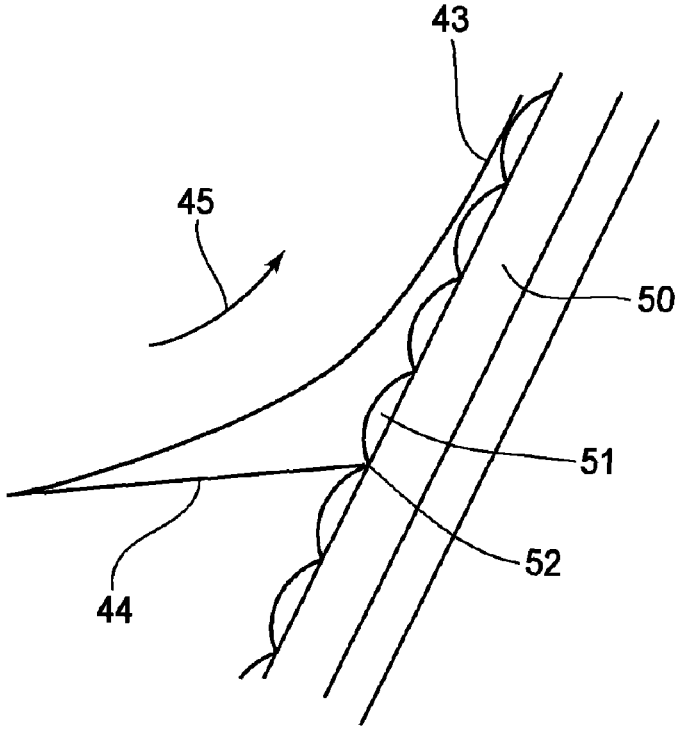
FIG. 15 is a partial side view showing a state in which an uppermost sheet is separated from subsequent sheets at a separating surface of a separating member.
Figure 16:
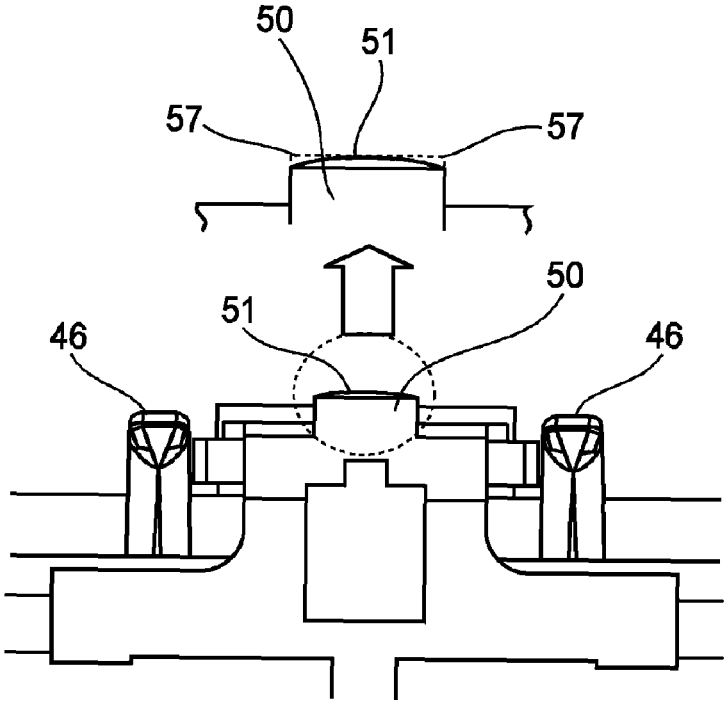
FIG. 16 is a partial plan view of the separating member at the separating portion and its neighborhood viewed from above.

FIG. 10 is a side view showing the separating portion 13 of the sheet feeding apparatus according to the embodiment of the present invention. FIG. 11 is a longitudinal sectional view showing an attitude of the sheet S fed from the sheet feeding roller to the conveying roller 31. FIG. 12 is a longitudinal sectional view showing an attitude of the sheet S conveyed by the conveying roller 31. FIG. 13 is a front perspective view of the separating portion 13 viewed from a sheet feeding roller side. FIG. 14 is a plan view showing the sheet feeding apparatus according to the embodiment of the present invention, wherein a part of constitutional members of the sheet feeding apparatus is omitted. FIG. 15 is a partial side view showing a state in which an uppermost sheet is separated from subsequent sheets at a separating surface of the separating portion 13. FIG. 16 is a partial plan view of the separating member at the separating portion 13 and its neighborhood viewed from above.

In FIGS. 10-16, a separating member 50 is disposed at a position which is downstream from the sheet feeding roller 21 with respect to the sheet feeding direction and is close to the end portion of the sheet stacking portion 11. This separating member 50 prevents double feeding of second and subsequent sheets together with the uppermost sheet when the uppermost sheet is picked up by the sheet feeding roller 21.

In FIGS. 13 and 14, the separating member 50 is disposed at an intermediary position with respect to a left-right direction of the leading end reference portion 23. Further, at the leading end reference portion 23, the inclined surface 46 for guiding a leading end of a picked-up sheet is formed. The inclined surface 46 is constituted by an upper surface of a plurality of rib-shaped projections formed at a predetermined interval. The inclined surface 46 is formed as an oblique-angled surface with respect to the stacked sheets as shown in FIG. 10. An upper surface of the separating member 50 is protruded from the inclined surface 46 and is formed as an obtuse-angled surface with respect to the stacked sheets similarly as in the case of the inclined surface 46. At the obtuse-angled (inclined) surface of the separating member 50, a plurality of arcuate projections 51 continuously disposed at a predetermined pitch with respect to the sheet feeding direction is formed. Between respective adjacent projections 51, a valley (bottom) portion 52 is located as shown in FIG. 15.

The separating member 50 is located downstream from the sheet feeding roller 21 with respect to the sheet feeding direction and is attached to the inclined surface 46 constituting the leading end reference portion 23. Further, as shown in FIG. 14, positions of the separating member 50 and the sheet feeding roller 21 with respect to a width direction are deviated from each other. More specifically, the separating member 50 is located at a position with a distance of 4-7 mm from a widthwise center line 56 of the sheet feeding roller 21 with respect to a direction of a sheet feeding roller axis 76.

Referring to FIG. 15, when an uppermost sheet 43 is picked up from the sheet stacking portion 11 by the swing arm type sheet feeding means 20, only the uppermost sheet 43 is fed along a conveying (feeding) path 45, but a subsequent sheet 44 is struck against the valley portion 52 at its leading end and is thus stopped.

That is, the uppermost sheet 43 is fed by a large frictional force between the sheet feeding roller 21 and the sheet 43, so that its leading end is movable along a separating surface constituted by the projections 51 and the valley portions 52. For this reason, only the uppermost sheet 43 is moved along the conveying path (indicated by an arrow) 45. On the other hand, the subsequent sheet 44 drawn by a small frictional force between the sheets is prevented from moving along the conveying path 45 by the separating member 50.

As shown in FIG. 16, the separating member 50 is rounded at corner portions 57. This is because the leading end of the uppermost sheet 43 is caused to smoothly come out of the valley portions 52 and readily pass through the projections 51 even when the uppermost sheet 43 meets with a large resistance by the valley portions 52. By this constitution, even when the sheet S meets with the large resistance by the separating member 50, it is possible to overcome such a disadvantage that the sheet S is damaged.

FIG. 11 shows a state in which the sheet S separated by the separating member 50 is fed by the sheet feeding roller 21 and a leading end of the sheet S reaches the nip between the conveying roller 31 and the pinch roller 32. The sheet S is conveyed to the conveying roller 31 while contacting the inclined surface 46, an outer conveying guide 47, an outer conveying guide 48, and an upper surface of the supporting member 63 in this order. That is, the sheet S is conveyed while outwardly expanding the conveying path.

Next, when rotational drive of the conveying roller 31 is started after the leading end of the sheet S is sent to the nip of the conveying roller 31, the sheet S is conveyed toward the sheet discharge roller 33 by the conveying roller 31. At this time, the attitude of the sheet S in the reverse conveying path 29 and the horizontal conveying path 41 is changed as shown in FIG. 12. More specifically, the sheet S is attracted inwardly in the conveying paths and conveyed while contacting inner guide portions in the conveying paths. For this reason, the swing arm 22 is raised via the sheet feeding roller 21, so that bouncing motion of the swing arm 22 is caused to occur during the sheet feeding. There is a possibility that such motion leads to destabilization of the sheet feeding operation and an occurrence of noise, so that it is desirable that the bouncing motion is prevented.

In this embodiment, at an intermediary inner guide portion in the sheet conveying path, a rotatable member 4 is disposed so that the sheet during the conveyance can contact a peripheral surface of the rotatable member 54. Further, at a position between the sheet feeding roller 21 and the rotatable member 54 in the conveying path of the sheet S, a guide portion 55 for supporting the sheet S in contact with the sheet S is provided. This guide portion 55 is, as shown in FIGS. 11 and 12, disposed outside a tangent line connecting the sheet feeding roller 21 and the rotatable member 54 so as to press the sheet S. By constitutions of the rotatable member 54 and the guide portion 55 described above, it is possible to prevent or alleviate the above described bouncing motion of the swing arm 22.

According to this embodiment described above, by canceling the self-weight moment of the swing arm type sheet feeding means 20 when the stacking amount of the sheets S is small, it is possible to easily and smoothly set the sheets S even in the case of setting a small amount of sheets in the sheet stacking portion 11. On the other hand, in the case where the sheet stacking amount is large, in addition to the self-weight moment of the swing arm type sheet feeding means 20, by causing moment to act on the sheets in the same direction as that of the self-weight moment, it is possible to maintain the pressing force exerted from the sheet feeding roller 21 on the sheets. As a result, it is possible to perform smooth and stable sheet feeding.

Further, this embodiment is constituted so that the plurality of arcuate projections 51 continuously disposed in the sheet feeding direction at the inclined surface of the separating member 50 disposed with an obtuse angle at the end of the sheet stacking portion 11 is provided and second and subsequent sheets are separated by the projections 51. For this reason, it is possible to separate the uppermost sheet from the second and subsequent sheets by the projections 51 in the case where a plurality of sheets is picked up.

Further, outside the tangent line connecting the sheet feeding roller 21 of the swing arm type sheet feeding means 20 and the rotatable member in the conveying path 29, the guide portion 55 contactable with the sheet S is provided, so that it is possible to prevent or alleviate the bouncing motion of the swing arm 22 when the sheet S is fed or conveyed. As a result, it is possible to prevent a lowering in conveyance accuracy and an occurrence of noise.

The above described embodiment is applicable regardless of a shape and operation method of the sheet feeding apparatus so long as the sheet feeding apparatus feeds sheets of the recording medium, the original, or the like from the sheet stacking portion one by one. Further, in the case where the image forming portion 65 is constituted by the recording portion, it is possible to employ various recording methods so long as the recording methods effect image recording on sheets by a recording means on the basis of image information. For example, it is possible to employ recording apparatuses of a laser beam type, a thermal transfer type, a heat-sensitive type, and a wire dot type, in addition to an ink jet recording apparatus for effecting recording by ejecting ink from ejection outlets of a recording head. A recording portion may be of any type including a serial type wherein recording is effected by a recording head mounted to a reciprocating carriage or a line type wherein recording is effected only by subscanning (conveyance) of a recording medium by using a recording head extending in a width direction of the recording medium.

According to the embodiment of the present invention, even in the case of setting a small amount of sheets at the sheet stacking portion, it is possible to provide a sheet feeding apparatus capable of easily setting the sheets without causing inconveniences such as buckling of the sheets and the like. Further, in the case of a large sheet stacking amount, it is possible to provide a sheet feeding apparatus capable of ensuring a sheet pressing force of the sheet feeding means and maintaining a stable sheet feeding performance.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 187921/2006 filed Jul. 7, 2006, which is hereby incorporated by reference.

What is claimed is:

1. A sheet feeding apparatus comprising:

a sheet stacking portion for stacking a sheet;

a sheet feeding roller for feeding the sheet stacked on said sheet stacking portion;

a supporting member, rotatably supported by a base member, for rotatably supporting said sheet feeding roller; and a spring stretched between a hook portion of the base member and an acting portion of said supporting member, wherein the hook portion is located nearer to said sheet feeding roller than to the acting portion, wherein the acting portion of said supporting member is located downward with respect to a rotation center of said supporting member when a sheet stacking amount is small, and the acting portion of said supporting member is located upward with respect to the rotation center of said supporting member when the sheet stacking amount is large.

2. An apparatus according to claim 1, wherein said spring is disposed so that moment generated about a rotation center axis of said supporting member is changed depending on a change in position at which said supporting member is rotated.

3. An apparatus according to claim 1, further comprising a sheet feeding roller gear disposed coaxially with said sheet feeding roller so as to transmit a driving force from the base member to said sheet feeding roller through said sheet feeding roller gear.

4. An apparatus according to claim 1, wherein the sheet is separated by an inclined surface forming an obtuse angle with the sheet stacked on said sheet stacking portion.

5. An apparatus according to claim 4, wherein at the inclined surface, a plurality of arcuate projections continuously disposed in a sheet feeding direction is provided.

6. An apparatus according to claim 1, further comprising:

a reverse feeding path for feeding the sheet, fed by said sheet feeding roller, in a U-turn manner;

a rotation member rotatable in contact with the sheet inside said reverse feeding path; and a guide disposed between said sheet feeding roller and said rotation member.

7. A sheet feeding apparatus comprising:

a sheet stacking portion for stacking a sheet;

a sheet feeding roller for feeding the sheet stacked on said sheet stacking portion;

a supporting member, rotatably supported by a base member, for rotatably supporting said sheet feeding roller; and a spring stretched between the base member and said supporting member, wherein a force of the spring acts on the supporting member downwardly with respect to a rotation center of said supporting member when a sheet stacking amount is small, and the force of the spring acts on said supporting member upwardly with respect to the rotation center of said supporting member when the sheet stacking amount is large.

8. A recording apparatus for effecting recording on a sheet with a recording head, comprising:

a sheet feeding apparatus comprising:

a sheet stacking portion for stacking a sheet;

a sheet feeding roller for feeding the sheet stacked on said sheet stacking portion;

a supporting member, rotatably supported by a base member, for rotatably supporting said sheet feeding roller; and a spring stretched between a hook portion of the base member and an acting portion of said supporting member, wherein the hook portion is located nearer to said sheet feeding roller than to the acting portion; and a recording portion for effecting recording on a sheet fed by said sheet feeding apparatus with a recording head, wherein the acting portion of said supporting member is located downward with respect to a rotation center of said supporting member when a sheet stacking amount is small, and the acting portion of said supporting member is located upward with respect to the rotation center of said supporting member when the sheet stacking amount is large.

* * * * *